US005156467A

United States Patent [19]

Kitahara et al.

[11] Patent Number: 5,156,467

[45] Date of Patent: Oct. 20, 1992

[54] PRINTER WITH MEDIA THICKNESS ADJUSTMENT OF PLATEN

[75] Inventors: Satoshi Kitahara; Kazuaki Sugimoto, both of Mishima; Tsugio Shiozaki, Susono; Mitsuo Uchimura, Numazu, all of Japan

[73] Assignee: Tokyo Electric Co., Ltd., Tokyo, Japan

[21] Appl. No.: 728,573

[22] Filed: Jul. 11, 1991

[30] Foreign Application Priority Data

Jul. 13, 1990 [JP] Japan ..... 2-184034
Jul. 31, 1990 [JP] Japan ..... 2-201138

[51] Int. Cl.[5] ..... B41J 11/20
[52] U.S. Cl. ..... 400/58; 400/120
[58] Field of Search ..... 400/54, 56, 58, 82, 400/120

[56] References Cited

U.S. PATENT DOCUMENTS 3,837,461 9/1974 Waibel ..... 400/82
4,227,819 10/1980 Manriquez ..... 400/58
4,575,267 3/1986 Brull ..... 400/58
4,655,625 4/1987 Brull et al. ..... 400/58
4,938,616 7/1990 Shiozaki et al. ..... 400/120

FOREIGN PATENT DOCUMENTS 0120776 6/1986 Japan ..... 400/82
0119077 5/1987 Japan ..... 400/58

OTHER PUBLICATIONS

"Constant Free-Flight Adjustable Platen for Impact Printer" IBM Tech. Discl. Bulletin, vol. 14, No. 7, Dec. 1971, pp. 2193-2194.

*Primary Examiner*—Eugene H. Eickholt
*Attorney, Agent, or Firm*—Frishauf, Holtz, Goodman & Woodward

[57] ABSTRACT

A printer includes a platen roller and a print head for printing information on a recording medium moving between the platen roller and the head in a predetermined direction. The platen roller is supported by a supporting frame which is rotatably mounted on a supporting shaft so that the platen roller is rockable in directions to touch and leave the head. The platen roller is pressed against the head by an urging member. The platen roller is shifted in a direction in parallel to the moving direction by a shifting mechanism as the roller rocks, so that the position of the roller relative to the head is kept constant with respect to the moving direction of the recording medium.

17 Claims, 8 Drawing Sheets

PRINTER WITH MEDIA THICKNESS ADJUSTMENT OF PLATEN

BACKGROUND OF THE INVENTION

1. Field of the Invention

The present invention relates to a printer for printing information, such as bar codes, on a paper sheet transported between a platen and a print head, by means of the print head.

2. Description of the Related Art

The assignee of the present invention proposes printers in U.S. patent applications U.S. Ser. No. 595,355 filed Oct. 9, 1990 now U.S. Pat. No. 5,085,533 and U.S. Ser. No. 596,093 filed Oct. 11, 1990. These printers comprise a printing section which includes a fixed print head and a platen movable in directions to touch and leave the head. The platen is in the form of a roller, whose opposite end portions are supported individually by means of a pair of arm-shaped platen frames. These frames are rockably mounted on a pivotal shaft, which is supported on a body frame of the printer. The platen roller is urged to be always pressed against the print head, by means of a torsion spring wound on the pivotal shaft, through the medium of the platen frames.

The spring force of the torsion spring is kept constant, so that the force (printing pressure) of the platen roller to press a paper sheet against the print head is also constant.

There are various printing papers which are different in thickness or hardness. Printing on thick or hard paper sheets requires a higher printing pressure than that on thin or soft paper sheets. If the spring force of the torsion spring is fixed, therefore, the printing pressure is liable to be insufficient for thick or hard paper printing. Thus, it is impossible to secure uniform print quality without regard to the thickness or hardness of the printing paper.

In the printer described above, moreover, the platen roller is supported by means of the platen frames which are rockable around the pivotal shaft. In the thick paper printing, the platen frame is rocked in the direction to recede from the print head for a distance corresponding to the paper thickness. Accordingly, the platen roller shifts its position, with respect to the print head, in the feeding direction of the paper sheet which passes between the head and the roller. In other words, the position of the platen roller relative to the print head changes in the paper feeding direction, depending on the paper thickness. Further, in the hard paper printing, since the passage of the paper is curved at the position of the platen roller, the paper applies to the platen roller with force urging the platen roller downward. Thus, as in the case of the thick paper printing, the platen roller is rocked in the direction to leave the print head and shifts its position, with respect to the print head, in the feeding direction of the paper sheet.

Consequently, the proper positional relationship between the print head and the platen is affected, so that the print quality is likely to lower. Thus, in the conventional arrangement, available papers for printing are limited.

SUMMARY OF THE INVENTION

The present invention has been contrived in consideration of these circumstances, and its object is to provide a printer capable of printing on various kinds of printing papers with uniform print quality.

In order to achieve the above object, a printer according to the present invention comprises: a platen; a print head for printing information on a recording medium moving between the platen and the print head in a predetermined direction; means for supporting the platen so that the platen is rockable in directions to touch and leave the print head; urging means for pressing the platen against the print head; and means for shifting the platen in a direction parallel to the predetermined moving direction of the recording medium as the platen rocks, so that the position of the platen relative to the print head is kept constant with respect to the predetermined moving direction of the recording medium.

According to the printer constructed in this manner, when the platen is rocked in the directions to approach or recede from the print head, depending on the thickness of the recording medium used for printing, it is shifted in the moving direction of the medium by the shifting means as it rocks. Accordingly, the position of the platen relative to the print head can be kept constant without regard to the rotational position of the platen. Thus, the platen can be kept in a proper position for printing, so that desired print quality can be maintained irrespectively of the kind of the recording medium used for the printing.

Preferably, moreover, the printer according to the present invention further comprises means for adjusting the urging force of the urging means in accordance with the thickness or hardness of the recording medium used. In this case, the force of the platen to press the recording medium against the print head, that is, printing pressure, can be adjusted to a proper value suited for the thickness or hardness of the recording medium used.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 to 11 show a printer according to an embodiment of the present invention, in which:

FIG. 1 is a front view schematically showing an essential part of the printer;

FIG. 2 is a side view, partially in section, showing a printing mechanism of the printer;

FIG. 3 is a perspective view of a platen unit;

FIG. 4 is a sectional view of a spring force adjusting mechanism taken along line IV—IV of FIG. 1;

FIG. 5 is a side view of an auxiliary force applying mechanism;

FIG. 6 is a side view, partially in section, showing the platen unit and its surroundings adjusted for thin paper printing;

FIG. 7 is a sectional view showing the relationship between a print head and the platen unit in the state shown in FIG. 6;

FIG. 8 is a side view, partially in section, showing the platen unit and its surroundings adjusted for medium-thickness paper printing;

FIG. 9 is a sectional view showing the relationship between the print head and the platen unit in the state shown in FIG. 8;

FIG. 10 is a side view, partially in section, showing the platen unit and its surroundings adjusted for thick paper printing; and FIG. 11 is a sectional view showing the relationship between the print head and the platen unit in the state shown in FIG. 10.

DETAILED DESCRIPTION OF THE PREFERRED EMBODIMENTS

A label printer according to an embodiment of the present invention will now be described in detail with reference to the accompanying drawings.

Figure 1:
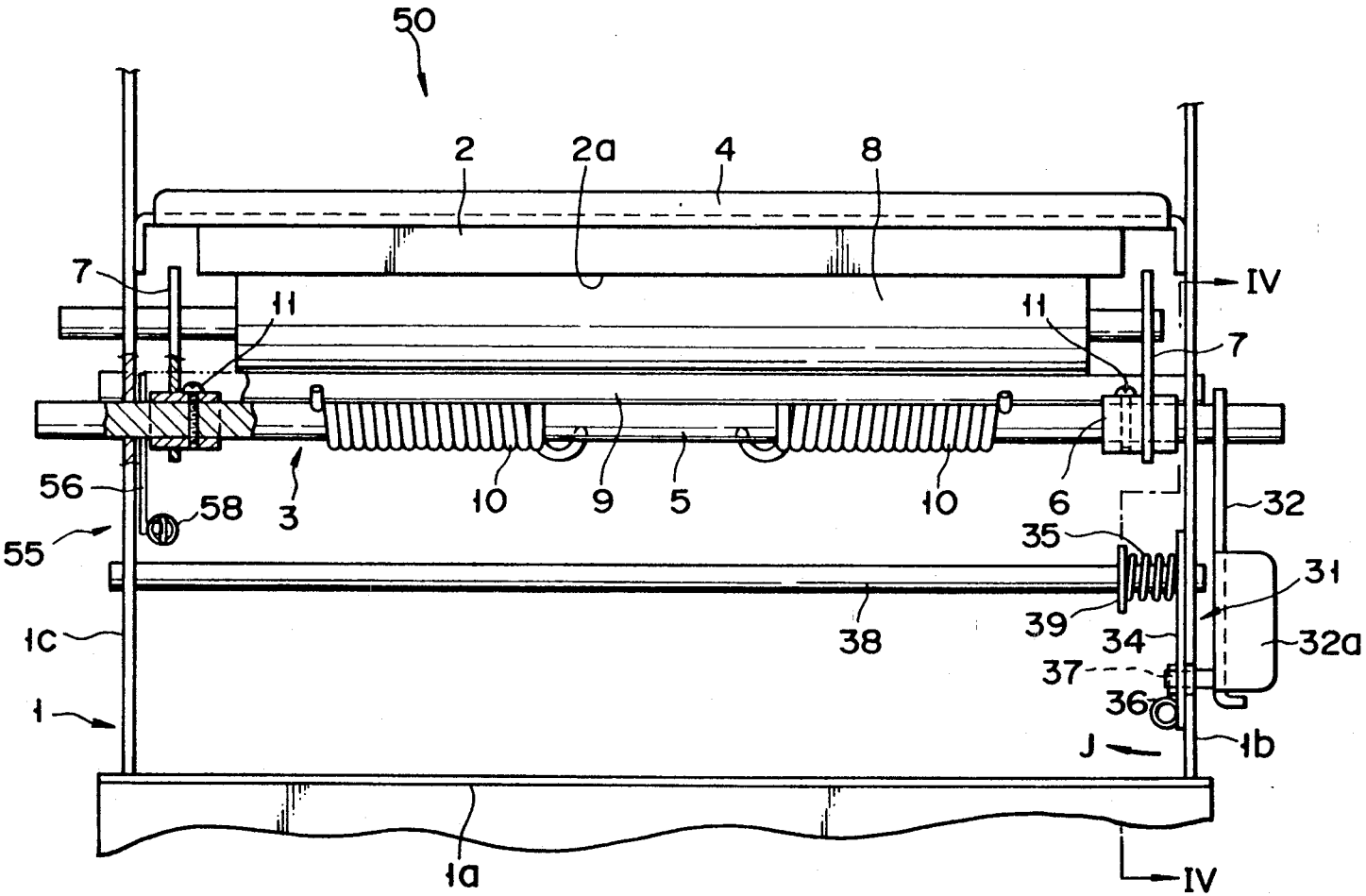
Figure 2:
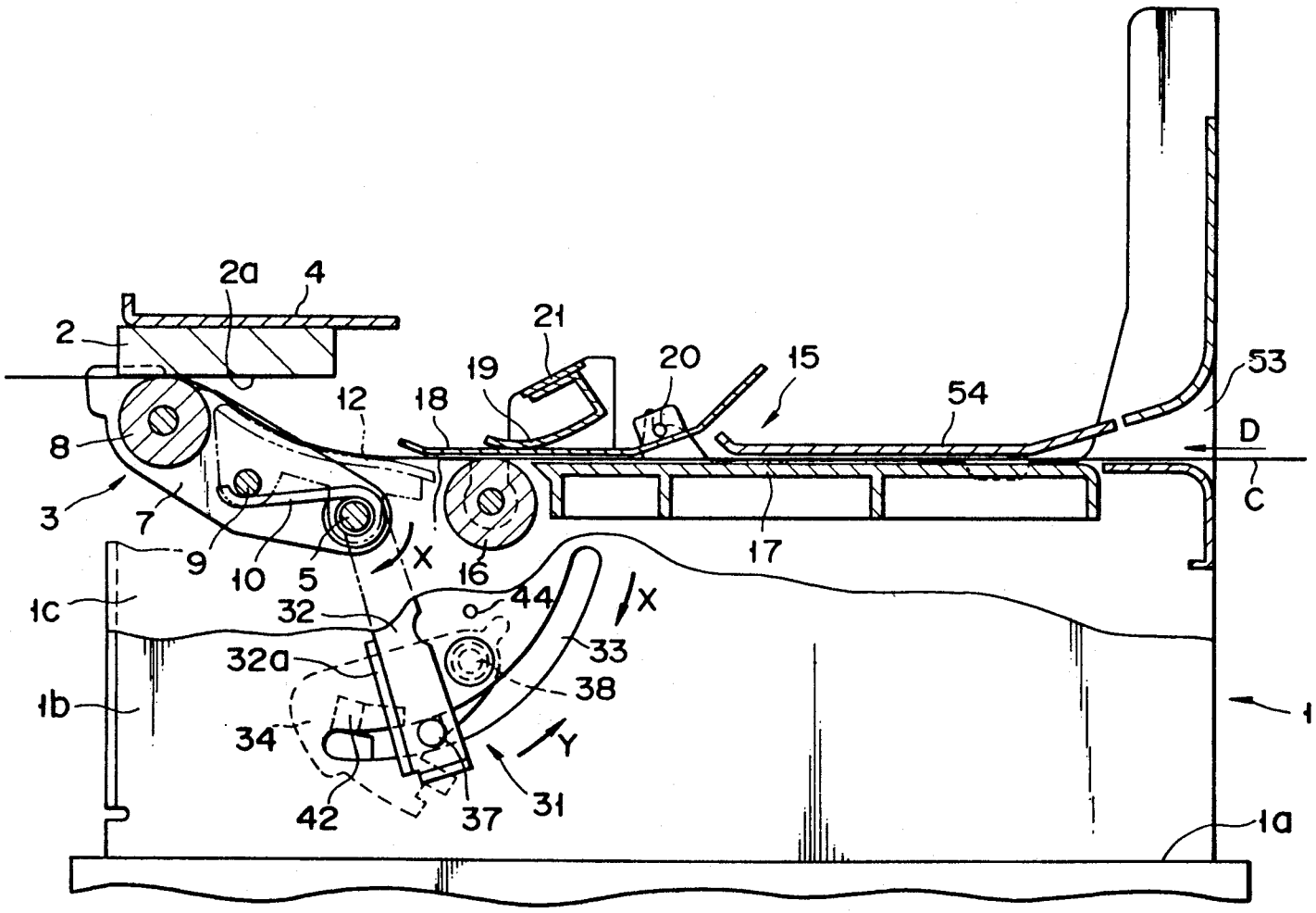

As shown in FIGS. 1 and 2, the printer comprises a body frame 1 which is covered by a removable case (not shown), and a printing mechanism 50 is attached to the frame 1. The body frame 1 includes a substantially horizontal bottom plate 1*a* and a pair of frame side plates 1*b* and 1*c*, right and left, which are set up on either side portion of the bottom plate so as to face each other.

A print head 2 and a platen unit 3 are arranged between the frame side plates 1*b* and 1*c*, the former overlying the latter. The print head 2, which is formed of a line thermal head, has a length substantially equal to the axial length of a platen roller (mentioned later), and is fixed to the underside of a head frame 4 which is fixedly stretched between the side plates 1*b* and 1*c*.

Figure 3:
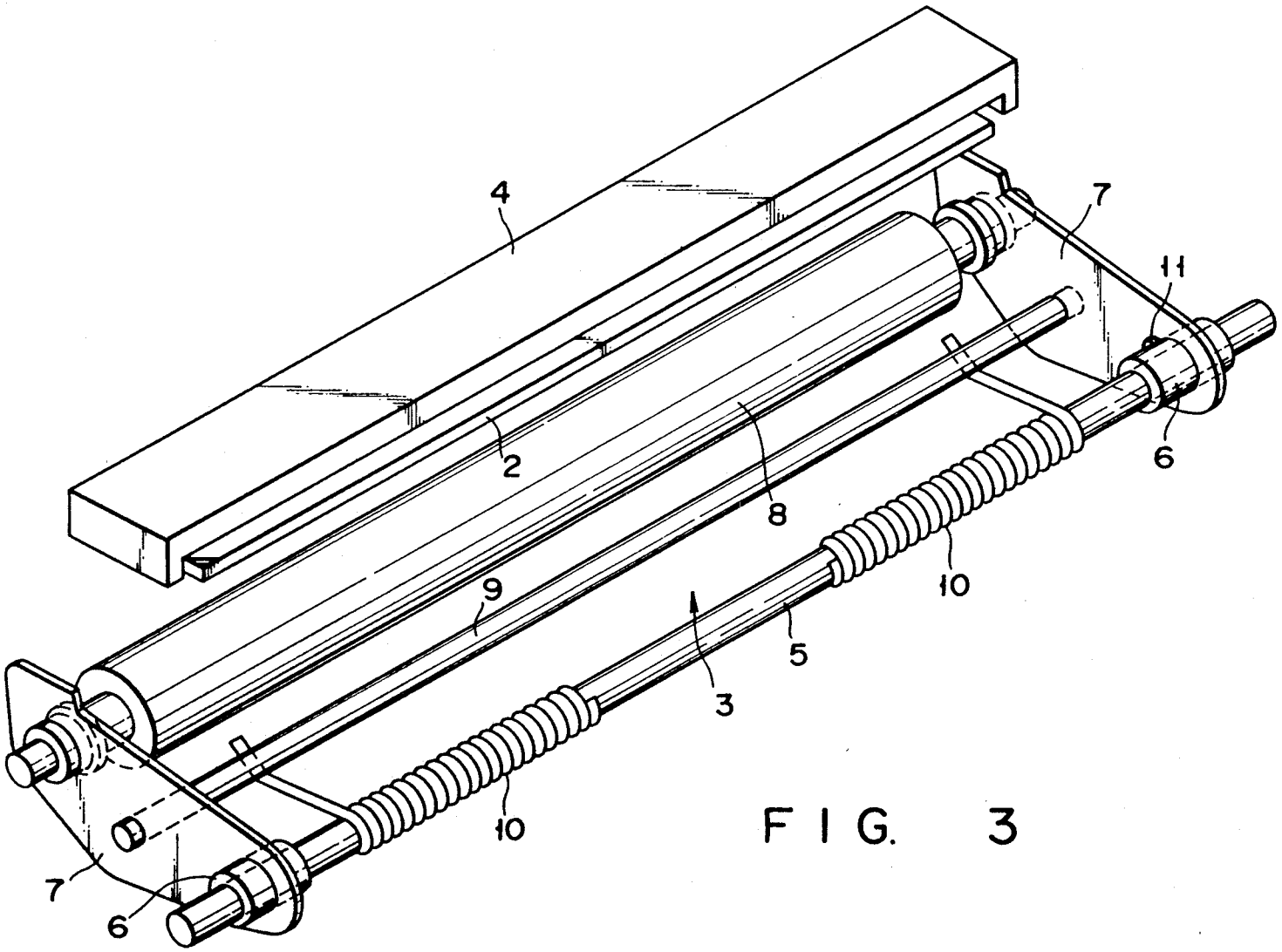

As shown in FIGS. 1 to 3, the platen unit 3 includes a pivotal shaft 5, a pair of eccentric cams 6, a pair of supporting plates 7, the platen roller 8, a pressure shaft 9, and a pair of torsion coil springs 10.

The pivotal shaft 5, which is stretched between the side plates 1*b* and 1*c*, is situated diagonally below and at the back of the print head 2 so as to extend parallel thereto. The two opposite end portions of the shaft 5 extend individually through the side plates 1*b* and 1*c* to the outside, and are supported for rotation around the axis of the shaft 5.

Figure 7:
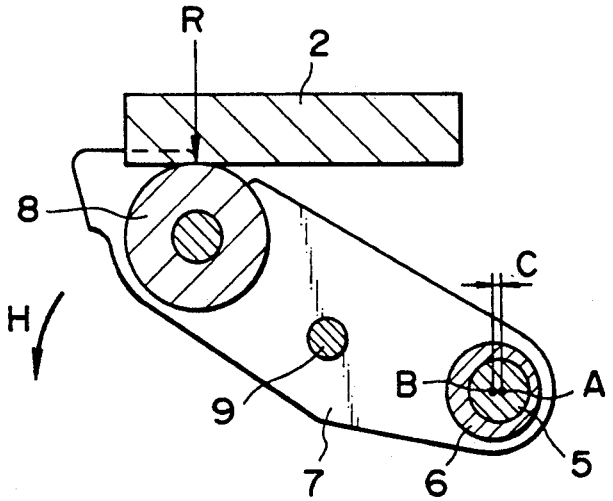

As shown in FIGS. 1, 3 and 7, the columnar eccentric cam 6, which is formed independently of the pivotal shaft 5, is mounted on each end portion of the shaft 5 by means of a screw 11. The cam 6 is fixed to the shaft 5 so that its axis B is eccentric to an axis A of the shaft 5 for a distance C. The cam 6 may alternatively be formed integrally with the pivotal shaft 5.

The respective rear end portions of the supporting plates are rockably fitted on their corresponding eccentric cams 6, and individually face the respective inner surfaces of the side plates 1*b* and 1*c*. Thus, each supporting plate 7 is supported by means of the pivotal shaft 5 so as to be rockable around the axis B of its corresponding cam 6.

The platen roller 8 is formed of a roller shaft and a rubber roller section fitted thereon. The roller shaft of the roller 8, which is rotatably stretched between the respective front end portions of the supporting plates 7, extends parallel to the pivotal shaft 5.

Figure 4:
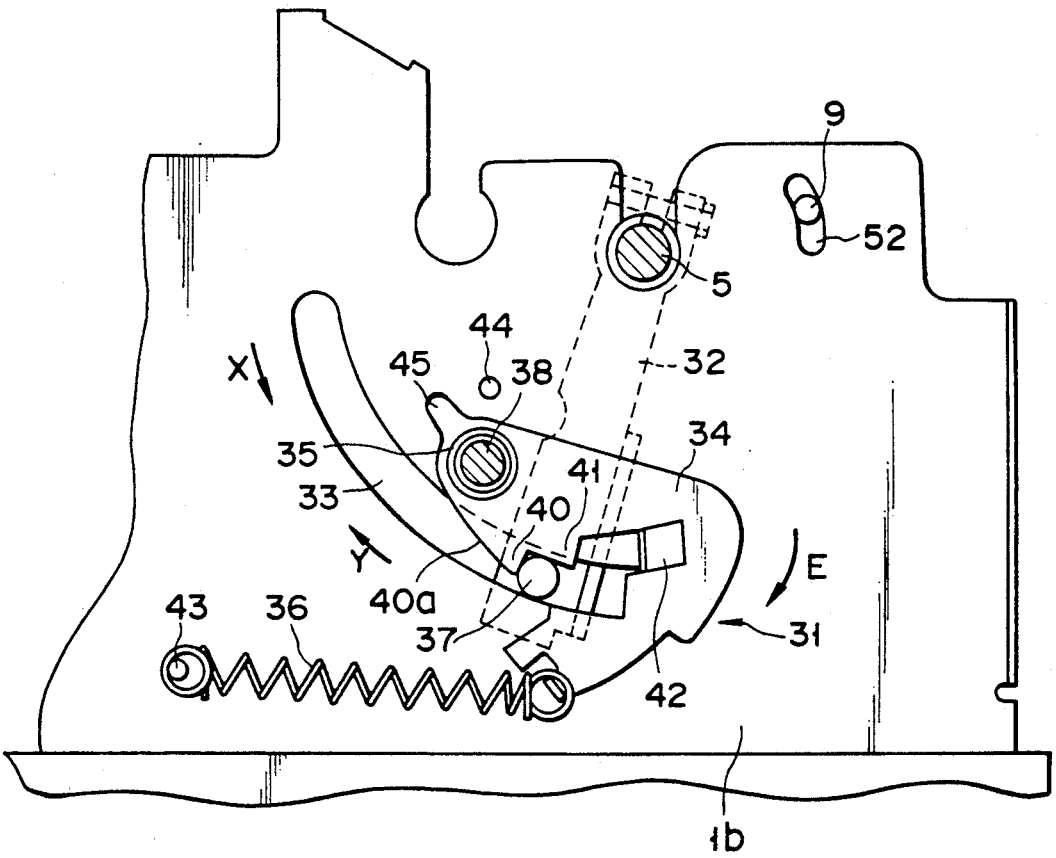
Figure 5:
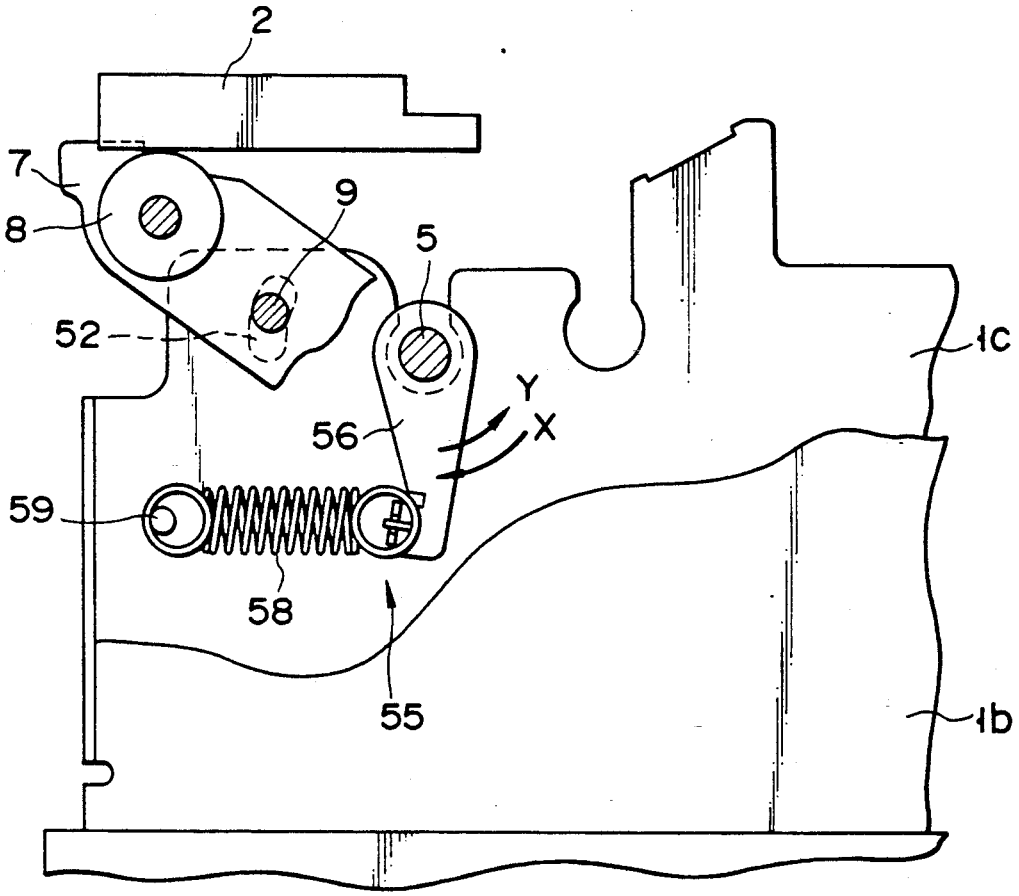

The pressure shaft 9 is stretched between the supporting plates 7 so as to be situated between the pivotal shaft 5 and the platen roller 8. The two supporting plates 7 are connected to each other by of the pressure shaft 9. The shaft 9 and the plates 7, which may alternatively be formed integrally with one another, constitute a supporting frame. The pressure shaft 9 and the frame plates 1*b* and 1*c* constitute a supporting frame of the present invention. As shown in FIGS. 3 to 5, each end portion of the pressure shaft 9 penetrates its corresponding supporting plate 7, and is inserted in an arcuate slot 52 which is bored through its corresponding side plate.

The torsion coil springs 10 are wound in the same direction on the pivotal shaft 5. One end of each spring 10 is fixed to the shaft 5, while the other end is pressed against the pressure shaft 9 from under the same. Thus, the whole platen unit 3 except the pivotal shaft 5 is urged to rotate around the axis of each eccentric cam 6 toward the print head 2, by means of the spring force of the coil springs 10, and the platen roller 8 is pressed against a lower surface (printing surface) 2*a* of the print head 2.

In FIG. 2, numeral 12 denotes a paper guide which is attached to the platen unit 3 so as to be fitted on the pivotal shaft 5 and the pressure shaft 9. The guide 12 serves to guide a paper sheet C, fed into the body frame 1 through an inlet aperture 53 in the rear portion of the frame 1, to the position between the print head 2 and the platen roller 8. The paper used is an elongated continuous base paper on which labels are pasted at regular intervals. The platen roller 8 is rotated by means of a platen drive mechanism (not shown) which uses a pulse motor as its power source.

As shown in FIG. 2, a paper feed mechanism 15 is located between the frame side plates 1*b* and 1*c*, at the back of the platen unit 3. The mechanism 15 includes a feed roller 16, a lower paper guide 17, a paper retainer 18, and a backup leaf spring 19.

The feed roller 16, which adjoins the paper guide 12 and situated behind the same, is stretched between the side plates 1*b* and 1*c* for rotation. The roller 16 is rotated in synchronism with the platen drive mechanism. The lower paper guide 17, which is stretched between the side plates 1*b* and 1*c*, extends from the feed roller 16 to the paper inlet aperture 53. The paper retainer 18, which is in the form of a plate, doubles as a paper guide. It overlies the roller 16 and part of the lower paper guide 17. The front end portion of the retainer 18 extends to the position over the rear end portion of the paper guide 12. The paper retainer 18 is supported on the body frame 1 so as to be rockable around a pivot 20, and is urged downward to be pressed against the paper feed roller 16 by means of the backup leaf spring 19. The spring 19 is fixed to a transverse plate 2 which is stretched between the frame side plates 1*b* and 1*c*. An upper paper guide 54 extends from behind the paper retainer 18 to the aperture 53 so as to face the lower guide 17 with gap.

The paper sheet C is passed through the inlet aperture 53, as indicated by arrow D in FIG. 2, to be introduced into the position between the upper and lower guides 54 and 17, and is further advanced to be held between the feed roller 16 and the paper retainer 18. When the feed roller 16 of the paper feed mechanism 15 is driven in this state, the sheet C is delivered to the position between the print head 2 and the platen roller 8 with being guided by the paper guide 12.

As shown in FIGS. 1, 2 and 4, a spring force adjusting device 31 is connected to that end portion of the pivotal shaft 5 which is situated close to the frame side plate 1*b*. The device 31 includes an operating lever 32, a slot 33, a lock plate 34, coil springs 35 and 36, etc.

The operating lever 32 is opposed to the outer surface of the frame side plate 1*b*, and its one end portion is fixed to the pivotal shaft 5. Part of the other end of the lever 32 is bent outward, forming a finger hook portion 32*a* for manual operation. Thus, the pivotal shaft 5 can be rotated by pressing the lever 32. An engaging pin 37 protrudes from the other end of the operating lever 32 toward the side plate 1*b*. The pin 37 is passed through the slot 33 in the plate 1*b*. The slot 33 is in the form of a circular arc around the pivotal shaft 5, having its radius of curvature between the shaft 5 and the pin 37. When the operating lever 32 and the pivotal shaft 5 are rotated together, the engaging pin 37 can move in the slot 33. Thus, the lever 32 is rockable within an angular range defined by the slot 33.

The torsion springs 10 on the pivotal shaft 5 are wound in the direction of arrow X of FIG. 2. If the shaft 5, along with the operating lever 32, is rotated in the same direction as the winding direction of the springs 10, that is, in the direction of arrow X, therefore, each spring is tightened so that its spring force increases. On the other hand, if the supporting shaft 5 is rotated in the direction of arrow Y, which is opposite to the winding direction of the springs 10, each spring is loosened so that its spring force is reduced. Thus, the spring force of the torsion springs 10 is adjusted by rocking the operating lever 32, whereby the force of pressure contact between the platen roller 8 and the print head 2, that is, printing pressure, can be adjusted.

A shaft 38 is stretched between the frame side plates 1*b* and 1*c* and situated right over the central portion of the slot 33 with respect to the longitudinal direction thereof. The lock plate 34 for holding the operating lever 32 in a desired rotational position is rockably mounted on the shaft 38 so as to adjoin the side plate 1*b*. Further, the shaft 38 is fitted with a retaining ring 39 spaced from the lock plate 34, and is wound with the coil spring 35 between the ring 39 and the plate 34. The spring 35 presses the plate 34 against the inner surface of the frame side plate 1*b* by means of its spring force. The shaft 38 is passed through a through hole in the lock plate 34, the hole having a diameter greater than that of the shaft 38. Thus, the lock plate 34 can shift its position around the shaft 38 in the direction to recede from the side plate 1*b*.

As shown in detail in FIGS. 2 and 4, the lock plate 34 includes a first hook 40, which has a slanting surface 40*a* extending across the slot 33 as viewed sideways, and a second hook 41 continuous with the front side of the hook 40. The plate 34 further includes a release piece 42 located in front of the hooks 40 and 41. The piece 42, which is a protrusion raised from the lock plate 34, diagonally extends away from the side plate 1*b* and toward the hook 41.

The coil spring 36 is stretched between the lower end portion of the lock plate 34 and a spring peg 43 which protrudes from the inner surface of the frame side plate 1*b*. The lock plate 34 is urged to rock in the direction of arrow E around the shaft 38 by the spring 36. A stopper pin 44 protrudes from the inner surface of the side plate 1*b*. A lug 45 is formed integrally on the upper end portion of the lock plate 34. As the lug 45 engages the pin 44 (see FIG. 6), the plate 34 is prevented from being further rocked by the force of the coil spring 36 in the direction of arrow E.

As shown in FIGS. 1 and 5, an auxiliary force applying mechanism 55 is provided beside the side plate 1*a* The mechanism 55 includes a rocking lever 56 and a tension spring 58. The lever 56, having one end fixed to the pivotal shaft 5, is situated adjacent to the inner surface of the side plate 1*c*, and can rotate integrally with the shaft 5. The spring 58, which is stretched between the other end of the lever 56 and a spring peg 59 protruding from the inner surface of the side plate 1*c*, urges the lever 56 to rock in the direction of arrow X around the pivotal shaft 5. The spring 58, whose spring force is smaller than that of the torsion springs 10 on the shaft 5, applies an auxiliary force, in the direction of arrow X to tighten the springs 10, to the pivotal shaft 5 through the lever 56. Thus, the auxiliary mechanism 55 helps the operating lever 32 of the spring force adjusting device 31 to rock in the direction for increasing the spring force of the torsion springs 10.

In the label printer constructed in this manner, the paper sheet C is inserted into the body frame 1 through the inlet aperture 53, and is passed between the feed roller 16 and the paper retainer 18 and then between the head 2 and the platen roller 8. The sheet C is pressed against the printing surface 2*a* of the print head by means of the platen roller 8, which is subjected to an urging force, and is printed by means of the head 2 in this state.

Figure 6:
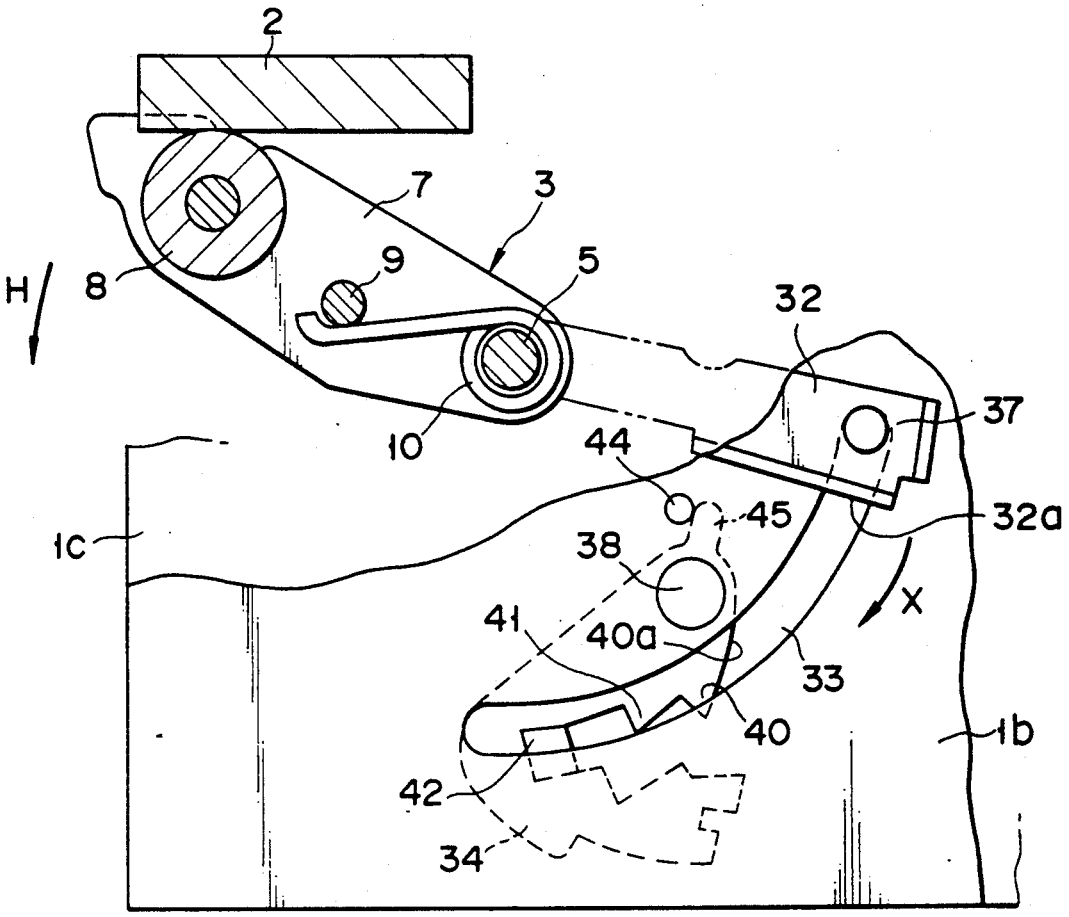

If the paper sheet C is as thin as about 160 microns, the spring force adjusting device 31 is not actuated, and the operating lever 32 is kept in its initial position, as shown in FIG. 6. In the initial position, the lever 32 is kept in a state such that its engaging pin 37 is caught by the upper end of the slot 33, by means of the spring force of the torsion springs 10. In this state, the springs 10 are twisted before-hand to a predetermined degree, so that the supporting plates 7 are subjected to a suitable spring force for thin paper printing. To attain this, the platen roller 8 presses the paper sheet C against the printing surface 2*a* of the print head 2 with a proper printing pressure.

In this state, moreover, the thickest wall portion of each eccentric ca 6 is situated in front of the pivotal shaft 5, as shown in FIG. 7. The platen roller 8, which is supported by mean of the supporting plates 7 fitted on their corresponding cams 6, is situated in a proper position relative to the print head 2, that is, opposite to a reference printing position R for the head 2.

In these conditions, therefore, the thin paper sheet can be printed under the proper printing pressure, which depends on its thickness, and with the platen roller 8 kept in the proper position with respect to the print head 2. Thus, predetermined print quality can be obtained.

Figure 8:
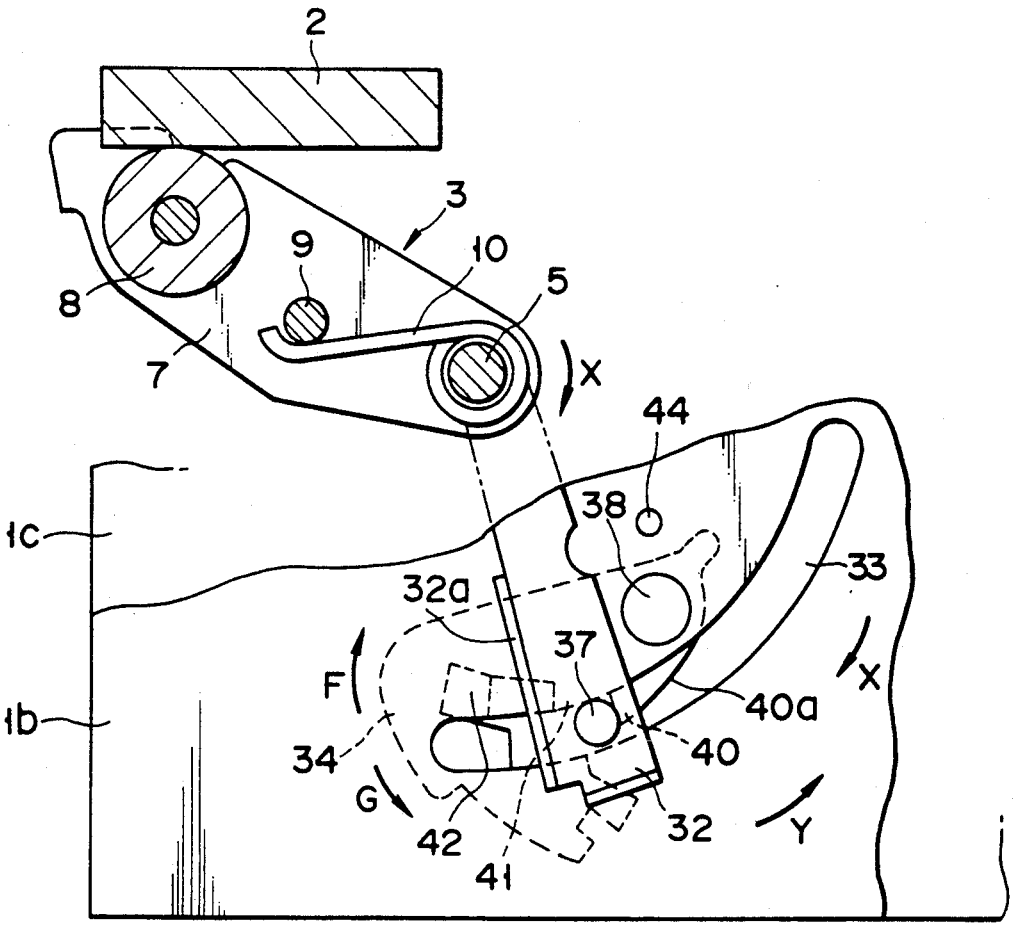

If the paper sheet used is as thick as 260 microns, for example, the operating lever 32 of the spring force adjusting device 31 is rocked in the direction of arrow X from its initial position, and is kept in a first adjustment position shown in FIG. 8. More specifically, as the lever 32 rocks, its engaging pin 37 moves in the slot 33, and abuts against the slanting surface 40*a* of the lock plate 34, thereby pressing the plate 34. As a result, the lock plate 34 is rocked in the direction of arrow F of FIG. 8, resisting the urging force of the tension spring 36, so that the slanting surface 40*a* recedes from the slot 33. The operating lever 32 is subjected to an urging force in the direction of arrow Y by means of the torsion springs 10 on the pivotal shaft 5, while the lock plate 34 is subjected to an urging force in the direction of arrow G by means of the spring 36. If an operating force is removed from the lever 32 when the slanting surface 40*a* of the plate 34 is cleared by the engaging pin 37, therefore, the lever 32 and the plate 34 are rocked in the directions of arrows Y and G, respectively. Thereupon, the pin 37 is caught by the first hook 40, so that the lock plate 34 is locked in the first adjustment position.

As the operating lever 32 rocks in the aforesaid manner, the pivotal shaft 5 is rotated in the direction of arrow X for the same angle as the angle of rotation of the lever. Accordingly, the torsion coil springs 10 are tightened so that its spring force increases. As a result, the force to press the platen roller 8 against the print head 2, that is, printing pressure, also increases. The angle of rotation of the operating lever 32 between the initial position and the first adjustment position and the spring force of the torsion springs 10 are adjusted so that the spring force of the springs 10 is set at a suitable value for thick paper printing when the lever 32 is in the first adjustment position. For example, the spring force for this case may be set at a value nearly twice that of the spring force obtained when the lever 32 is in the initial position.

Figure 10:
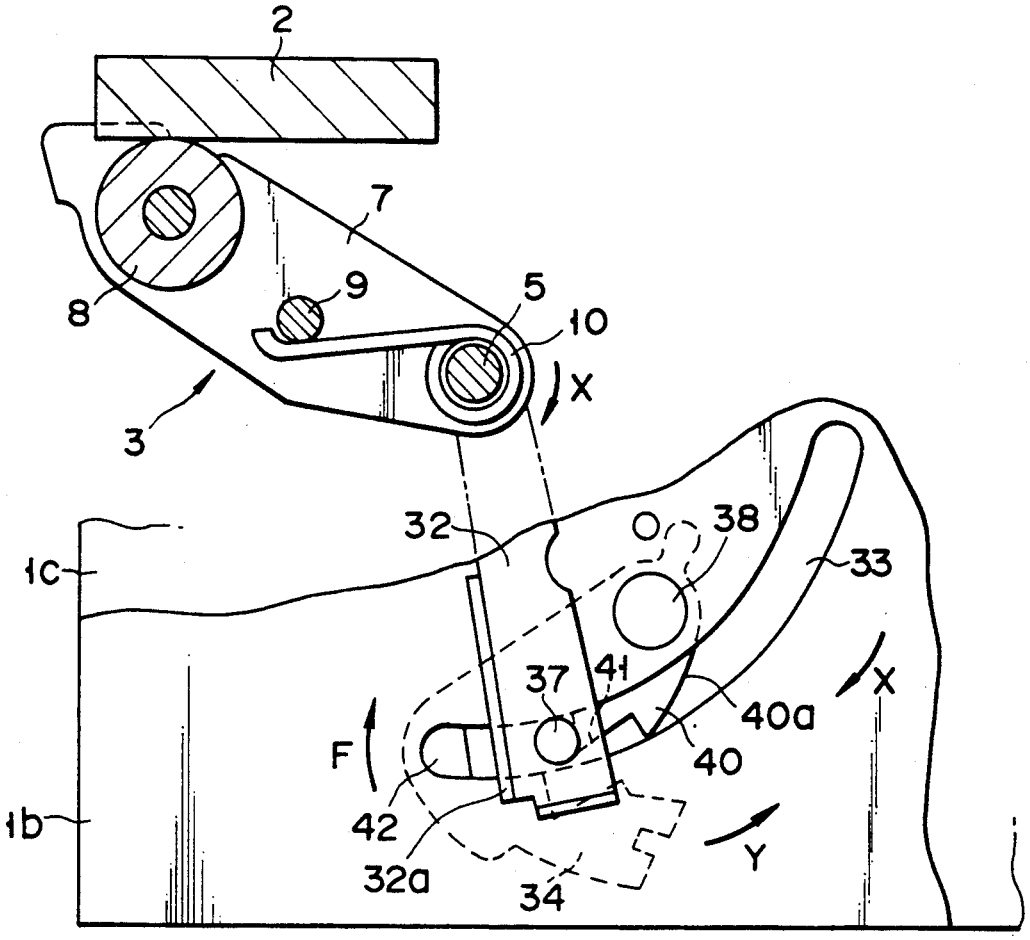

If a thicker paper sheet is used for printing, or if a higher printing pressure is required, the operating lever 32 is rocked in the direction of arrow X from the first adjustment position, and is locked in a second adjustment position shown in FIG. 10 by the lock plate 34. In this state, the lever 32 is locked in a manner such that its engaging pin 37 is in engagement with the second hook 41 of the plate 34. Naturally, the torsion springs 10 are tightened to a higher degree to provide a higher printing pressure when the lever 32 is in the second adjustment position, in which the pin 37 engages the second hook 41, than when the lever 32 is in the first position in which the pin 37 engages the first hook 40.

In this manner, the printing pressure can be adjusted to the paper hardness or thickness.

In rocking the operating lever 32 in the direction of arrow X, that is, in the direction to tighten the torsion springs 10, around the pivotal shaft 5, the spring force of the springs 10 acts as a reaction force, in the direction of arrow Y opposite to the rocking direction, on the lever 32 through the shaft 5. Therefore, a relatively great force is needed to rock the lever 32 in the direction of arrow X. According to the present embodiment, however, the pivotal shaft 5 is subjected to a torque in the direction of arrow X to tighten the torsion springs 10 by the agency of the rocking lever 56 and the tension spring 58 of the auxiliary force applying mechanism 55. Therefore, the reaction force in the direction of arrow Y, applied to the operating lever 32 by means of the springs 10, is reduced by the aforesaid torque produced by the mechanism 55. Thus, the operating force required in rocking the operating lever 32 from the initial position to the first or second adjustment position can be reduced.

When using a thick paper sheet, the platen roller 8, along with the supporting plates 7, is rotated in the direction of arrow H (see FIG. 7) to recede from the print head 2 as the paper thickness increases. As the roller 8 rotates in this manner its position relative to the head 2 is slightly deviated forward from the reference position R. In the thick paper printing, however, the printing pressure is adjusted, as mentioned before, so that the eccentric cams 6 are rotated together and in the sam direction with the pivotal shaft 5.

Figure 9:
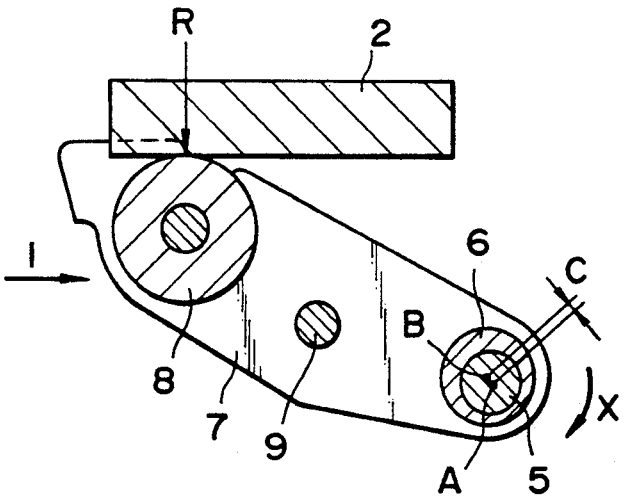
Figure 11:
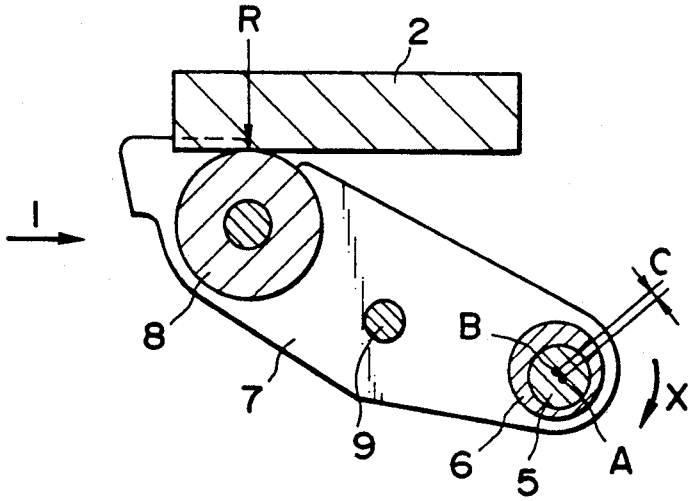

Thus, when the cams 6, along with the pivotal shaft 5, are rotated in the direction of arrow X as the operating lever 32 rocks in the same direction, as shown in FIG. 9 or 11, the axis B of each cam moves away from the platen roller 8 so that its thickest wall portion is situated on the top side of the shaft 5. Accordingly, the supporting plates 7 on the cams 6 are moved in the direction of arrow I of FIGS. 9 and 11, that is, in a direction parallel to the moving direction of the paper sheet C. Thus the forward dislocation of the platen roller 8, which accompanies the rocking motion of the plates 7 in the direction of arrow H, is compensated. In consequence, the roller 8 can always be kept in the reference position R with respect to the print head 2.

As described above, even a thick paper sheet can be printed under a proper printing pressure, which depends on its thickness, and with the platen roller 8 kept in the proper position with respect to the print head 2. Thus, the predetermined print quality can be obtained.

In general, when the position of the platen roller 8 is deviated from the proper position relative to the print head 2, the deviation may possibly be removed by pressing the roller 8 hard against the head 2. More specifically, the roller section of the platen roller 8 is subjected to a substantial elastic deformation such that the area of contact between the roller 8 and the print head 2 increases, that is, the range of the proper position of the roller 8 with respect to the head 2 widens. In this case, however, the torsion coil springs 10 should be ones with a great spring force. When the platen roller 8 is in the proper position relative to the print head 2, therefore, an undue load acts on the head 2. According to the printer of the present embodiment, however, the proper position of the roller 8 relative to the head 2 can be maintained without adjusting the printing pressure, as described above, so that springs with a small spring force can be used as the springs 10. Thus, the load on the print head 2, as well as the operating force of the operating lever 32, can be reduced.

The lock of the operating lever 32 can be released by further rocking the lever 32 in the direction of arrow X beyond the second adjustment position. When the engaging pin 37 reaches the lower end of the slot 33 as the lever 32 rocks, it abuts against the release piece 42 of the lock plate 34. Thereupon, the pin 37 is disengaged from the piece 42 while pressing the lock plate 34 in the direction of arrow J (see FIG. 1) to recede from the side plate lb, resisting the spring force of the coil spring 35. As a result, the lock plate 34 is pulled back to a release position shown in FIG. 6 by means of the spring force of the coil spring 36. If the operating lever 32 is released from a finger's hold in this state, it is returned to the initial position shown in FIG. 6 by means of the spring force of the torsion coil springs 10. At this time, the engaging pin 37 moves upward in the slot 33 in a manner such that its tip end slides on that surface of the lock plate 34 which faces the frame side plate lb. Naturally, the printing pressure is lowered by this unlocking operation.

According to the printer constructed in this manner, the printing pressure can be adjusted depending on the thickness and hardness of the paper used, and the platen can be kept in the proper position relative to the print head by changing the relative positions of the pivotal shaft and the supporting plates at the same time with the pressure adjustment. Thus, various kinds of printing papers can be printed with uniform print quality. Moreover, the printing pressure can be easily adjusted with a small force by the agency of the auxiliary force applying mechanism.

It is to be understood that the present invention is not limited to the embodiment described above, and that various changes and modifications may be effected therein by one skilled in the art without departing from the scope or spirit of the invention.

For example, the platen is not limited to the roller type, and may alternatively be of a plate type. The torsion springs ma be anchored to the supporting plates, in place of the pressure shaft, so that they directly urge the supporting plates. In this case, the pressure shaft may be omitted. Further, only one torsion spring is good enough.

The present invention may be applied to both a transfer printer using a transfer ribbon and a printer for printing without the use of the ribbon. Although the printing pressure can naturally be adjusted more finely if the lock plate has more hooks, only one hook is enough for the purpose.

In the embodiment described above, the supporting plates 7 are mounted on the pivotal shaft 5 by means of the eccentric cams 6. Even if the cams are omitted, however, the printing pressure can be adjusted, and this adjustment can be facilitated by means of the auxiliary force applying mechanism. In this case, the printing pressure can be adjusted depending on the quality, especially hardness, of the printing paper. More specifically, the printing pressure can be set high for hard paper and low for soft paper.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A printer comprising:

a platen;

a print head opposed to the platen, for printing information on a recording medium moving in a predetermined direction between the print head and the platen;

means for supporting the platen so that the platen is rockable in directions to contact and separate from the print head, the supporting means including a supporting shaft rotatable around an axis thereof, and a supporting frame mounted on the supporting shaft and rotatable around the supporting shaft, the supporting frame supporting the platen substantially in parallel to the supporting shaft;

urging means for pressing the platen against the print head; and means for shifting the supporting frame in a direction parallel to the predetermined moving direction of the recording medium as the supporting shaft is rotated, so that the position of the platen relative to the print head is kept constant with respect to the predetermined moving direction of the recording medium.

2. A printer according to claim 1, wherein said shifting means includes a columnar cam fixed eccentrically to the supporting shaft and means for rotating the cam integrally with the supporting shaft, and said supporting frame is supported on the supporting shaft while being fitted on the cam for rotation, the supporting frame being moved in the direction parallel to the predetermined moving direction as the cam rotates relatively thereto.

3. A printer according to claim 2, which further comprises means for adjusting the urging force of the urging means.

4. A printer according to claim 3, wherein:

said urging means includes a torsion spring wound in a predetermined winding direction on the supporting shaft, said torsion spring having one end fixed to the supporting shaft and another end engaging the supporting frame, and said adjusting means includes an operating member fixed to the supporting shaft so as to be rockable integrally therewith, for increasing the spring force of the torsion spring by rotating together with the supporting shaft in the predetermined winding direction and for reducing the spring force by rotating in a direction opposite to the predetermined winding direction, and means for holding the operating member in a desired rotational position, the operating member comprising the rotating means.

5. A printer according to claim 4, which further comprises a base member for supporting the print head and the supporting shaft, and wherein said holding means includes a guide portion formed on the base member along the path of transfer of the operating member and having first and second ends, an engaging portion for regulating the rotation of the operating member between an initial position, in which the operating member engages the first end of the guide portion, and a final position, in which the operating member engages the second end, and a lock member provided on the base member, the lock member having a first hook portion for engaging the engaging portion to hold the operating member in a first adjustment position, and a second hook portion for engaging the engaging portion to hold the operating member in a second adjustment position, the first and second adjustment positions being arranged successively at distances in the predetermined winding direction from the initial position.

6. A printer according to claim 2, wherein said print head is elongated and extends substantially in parallel to the supporting shaft.

7. A printer according to claim 2, which further comprises a base member for supporting the print head and the supporting shaft, and wherein said supporting frame includes a pair of supporting plates facing each other and a pressure shaft extending between the supporting plates, each of the supporting plates having one end rotatably fitted on the cam and another end supporting the platen.

8. A printer according to claim 4, which further comprises means for applying a force to the supporting shaft such that the supporting shaft is rotated in the predetermined winding direction.

9. A printer according to claim 8, wherein said applying means includes a rocking member fixed to the supporting shaft so as to be integrally rockable therewith, and an urging member for urging the rocking member in the predetermined winding direction, the urging force of the urging member being smaller than that of the urging means.

10. A printer according to claim 1, wherein said platen includes a platen roller rotatably supported by the supporting frame.

11. A printer according to claim 1, wherein said print head includes a line thermal head extending in parallel to the platen.

12. A printer according to claim 1, which further comprises means for adjusting the urging force of the urging means.

13. A printer according to claim 12, wherein:

said urging means includes a torsion spring wound in a predetermined winding direction on the supporting shaft, said torsion spring having one end fixed to the supporting shaft and another end engaging the supporting frame, and said adjusting means includes an operating member fixed to the supporting shaft so as to be rockable integrally therewith, for increasing the spring force of the torsion spring by rotating together with the supporting shaft in the predetermined winding direction and for reducing the spring force by rotating in a direction opposite to the predetermined winding direction, and means for holding the operating member in a desired rotational position, the operating member comprising the rotating means.

14. A printer according to claim 1, where said print head is elongated and extends substantially in parallel to the supporting shaft.

15. A printer comprising:

a print head;

a platen for pressing a recording medium against the print head, the recording medium moving between the print head and the platen in a predetermined direction;

a supporting shaft;

supporting means for supporting the platen, the supporting means being mounted on the supporting shaft so that the platen is rockable in directions to touch and leave the print head;

urging means for urging the platen against the print head, the urging means including a torsion spring wound in a predetermined winding direction on the supporting shaft;

means for adjusting the urging force of the urging means by rotating the supporting shaft in the predetermined winding direction to increase the spring force of the torsion spring and by rotating the supporting shaft in the direction opposite to the predetermined winding direction to reduce the spring force; and means for applying an auxiliary force, for rotating the supporting shaft in the predetermined winding direction, to the supporting shaft when the supporting shaft is rotated in the predetermined winding direction by means of the adjusting means.

16. A printer according to claim 15, wherein adjusting means includes an operating member fixed to the supporting shaft and rotatable integrally with the supporting shaft, and means for holding the operating member in a desired rotational position.

17. A printer according to claim 16, wherein said applying means includes a rocking member fixed to the supporting shaft and integrally rockable with the supporting shaft, and an urging member for urging the rocking member in the predetermined winding direction, the urging force of the urging member being smaller than that of the urging means.

* * * * *